United States Patent [19]

Peleckis

[11] Patent Number: 4,516,320

[45] Date of Patent: May 14, 1985

[54] DYNAMIC RAZOR

[75] Inventor: Anthony J. Peleckis, Fairfield, Conn.

[73] Assignee: Warner-Lambert Company, Morris Plains, N.J.

[21] Appl. No.: 489,634

[22] Filed: Apr. 28, 1983

[51] Int. Cl.[3] ..... B26B 21/06

[52] U.S. Cl. ..... 30/49; 30/50

[58] Field of Search ..... 30/50, 47, 40.1, 49

[56] References Cited

U.S. PATENT DOCUMENTS

| | | | |
|---|---|---|---|
| 3,587,171 | 6/1971 | Perry | 30/40.1 |
| 4,069,580 | 1/1978 | Cartwright | 30/50 |
| 4,324,041 | 4/1982 | Trotta | 30/47 |
| 4,443,939 | 4/1984 | Motta | 30/49 |
| 4,443,940 | 4/1984 | Francis | 30/50 |

*Primary Examiner*—Jimmy C. Peters

*Attorney, Agent, or Firm*—R. S. Strickler

[57] ABSTRACT

A method and apparatus for altering the normal blade geometry of a wet shaving razor in response to aggressive shaving forces, thereby avoiding nicks and cuts that would otherwise occur.

3 Claims, 8 Drawing Figures

FIG.1
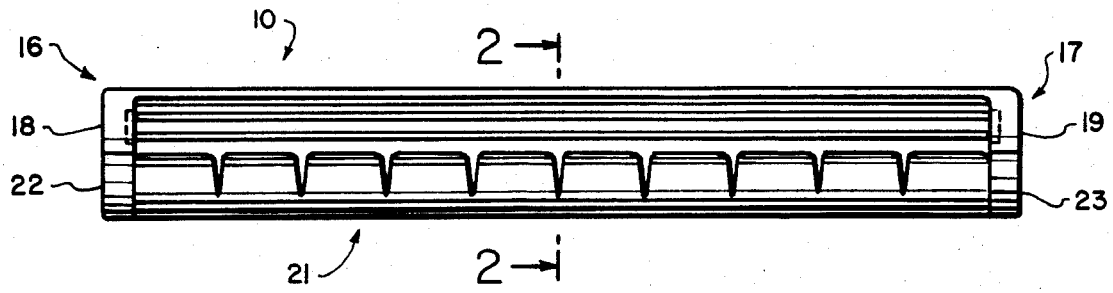
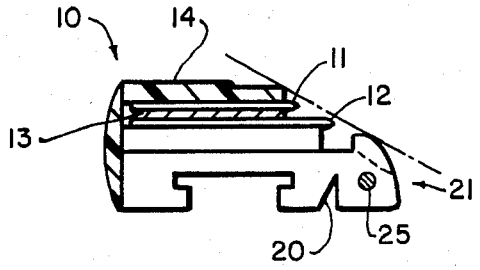
FIG.2
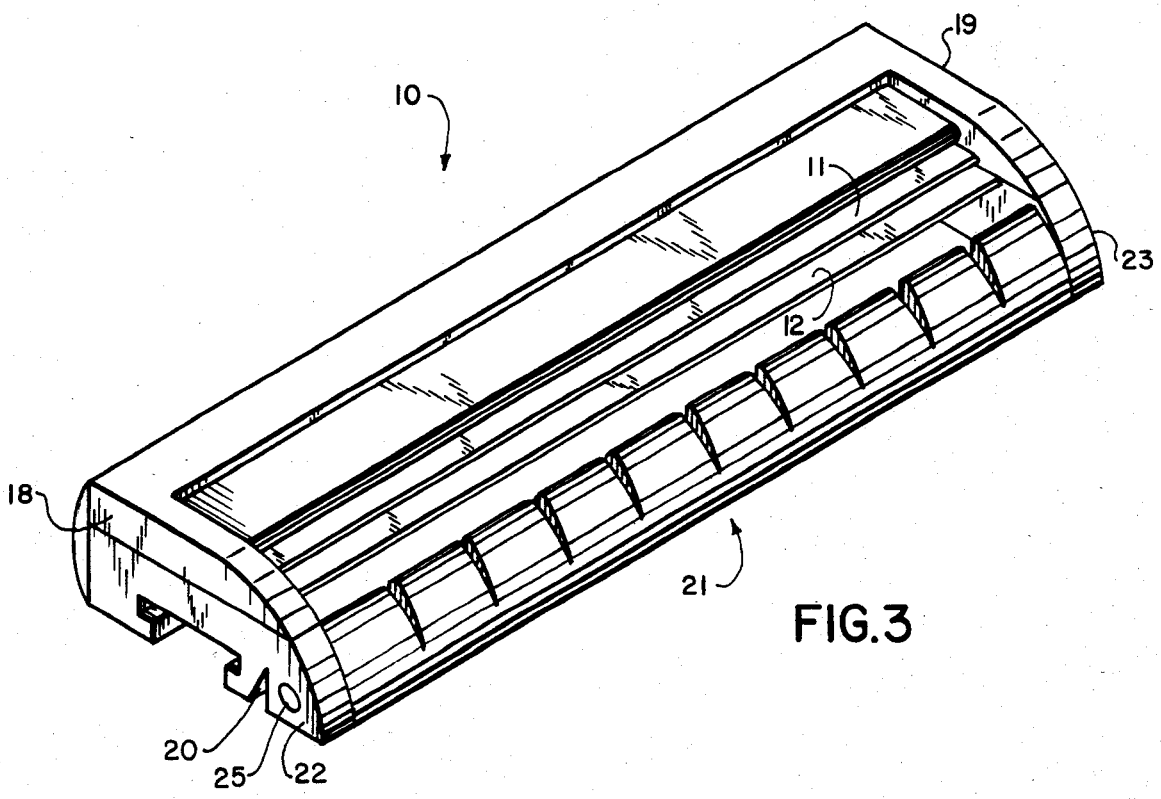
FIG.3

FIG.4
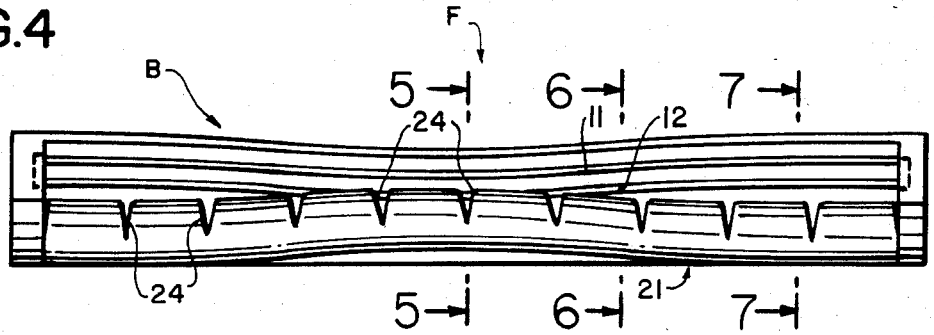
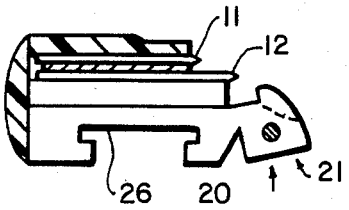
FIG.5
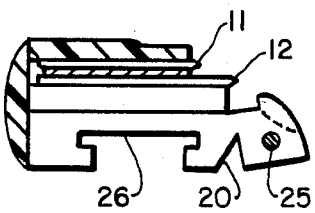
FIG.6
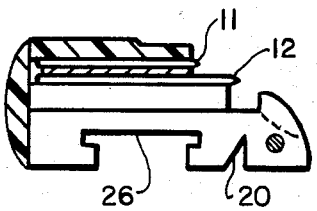
FIG.7
FIG.8
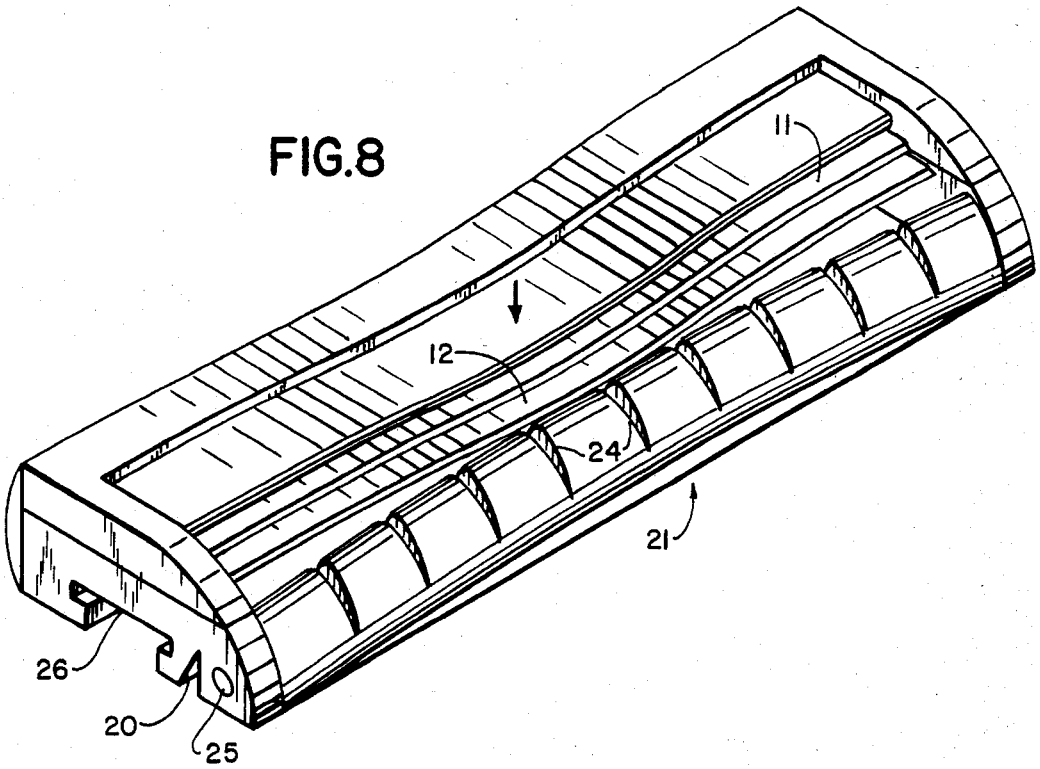

DYNAMIC RAZOR

BACKGROUND OF THE INVENTION

The present invention relates to razors and in particular to so-called wet shaving razors.

More specifically, this invention relates to those wet shaving razors which have been termed "dynamic", i.e., razors that accommodate automatically to various skin surfaces such as blemishes, wrinkles or creases which, if not shaved with care, develop cuts or nicks.

A dynamic razor is one which alters blade geometry automatically in response to shaving forces.

That is, when a shaver encounters an irregular skin surface, freqently his natural tendency is to shave with greater vigor or force, particularly in wrinkles or creases. To minimize the occurrence of cuts and nicks under these circumstances, the dynamic razor alters the blade geometry in proportion to the shaving force applied, thereby reducing substantially the risk of cutting and nicking.

The language "blade geometry", a term of art, relates to (1) the angle which the blade edge subtends with the plane of the skin surface, (2) the exposure of the blade edge or the normal distance the edge projects into the skin surface beyond the guard bar and (3) the spacing between the blade edge and the nearest portion of the guard bar which supports the skin.

Representative examples of prior art dynamic razors are shown and described in U.K. patent application No. 8124229 filed Aug. 7, 1981 [Publication No. 2,092,052 A published Aug. 11, 1982] and U.S. Pat. No. 4,337,575 issued July 6, 1982, to Robert A. Trotta.

SUMMARY OF THE INVENTION

It is an object of the present invention to provide a blade assembly of the dynamic type which is of different construction and of low cost relative to prior art dynamic razors.

It is a further object to provide a novel method of constructing a dynamic razor.

A representative embodiment of the present invention embracing its basic principles may comprise a flexible blade package having one or more blade edges supported at each end as a fixed beam, a cooperating blade guard, said blade package and guard being positioned relative to one another to provide optimum blade geometry, said blade package being operable in response to shaving forces to deflect relative to the guard effective to alter blade geometry.

A representative method of constructing a dynamic razor may comprise the steps of providing a guard bar having a predetermined resistance to bending and providing a cooperating relatively flexible blade package having a resistance to bending less than said guard bar such that normal shaving forces flex the blade package relative to the guard bar effective to alter blade geometry to a less aggressive attitude.

Other features and advantages of the present invention will become more apparent from an examination of the succeeding specification when read in conjunction with the appended drawings, in which;

BRIEF DESCRIPTION OF THE DRAWINGS

FIG. 1 is a front view of a dynamic razor embracing principles of the present invention illustrating normal blade geometry;

FIG. 2 is a vertical section of FIG. 1 in the plane of the line 2—2;

FIG. 3 is a perspective view of the razor cartridge of FIG. 1;

FIG. 4 is a front view of a razor cartridge stressed by shaving force F;

FIG. 5 is a vertical center section of the stressed cartridge of FIG. 4;

FIG. 6 is a vertical section in the plane of line 6—6;

FIG. 7 is a vertical section near the end of the blade package as viewed in the plane 7—7; and FIG. 8 is a perspective view of a stressed blade cartridge.

DESCRIPTION OF THE PREFERRED EMBODIMENT

Referring now to the drawings and in particular to FIGS. 1 through 3, the reference numeral 10 designates a blade package or blade cartridge comprising blades 11 and 12, spacer 13 and cap 14 secured together by gluing or riveting in well-known fashion to define a simple beam supported at opposed ends 16 and 17 by cap side walls 18 and 19, respectively. A guard bar 21, supported by and spanning walls 22 and 23, is formed with a plurality of serrations 24—24 and a track 26. Walls 22, 23 are secured to mating walls 18 and 19 by suitable means such as high frequency welding, gluing or the like.

The cap 14 and the guard bar 21, as well as walls 18, 19 and 22, 23, are molded of plastic material. The blades, cap and spacer, as a unitary assembly, have a resistance to bending induced by shaving forces F (FIG. 4) which is less than the corresponding bending resistance of the guard bar.

FIG. 2 shows a complete cartridge in the normal unstressed condition evidencing normal blade geometry, i.e., a blade angle $\alpha$ of 22 to 26 degrees, blade exposure ranging from 0.000–0.003 inches, and blade span of 0.055 to 0.060 inches.

Referring now in detail to FIGS. 4 through 8, a shaving force F, resulting from an aggressive or unduly vigorous shaving stroke, will cause the beam B to deflect as a classic simple beam with corresponding contraction of the end-to-end dimension of the overall cartridge. The guard bar 21, having greater resistance to bending, accommodates this reduction in span by rolling or buckling upwardly eased by the spreading of serrations 24—24.

If necessary, due to stiffness of plastic, buckling of the guard is further eased by the formation of a longitudinal V-shaped notch 20 which provides a hinge effect.

In contrast, in situations where it is desired to add stiffness to the guard bar, a rod 25 can be incorporated in the plastic. The stiffness provided by the rod does not detract from the hinge effect created by the longitudinal notch 20.

This deflection, contraction and buckling action alters the blade geometry which is most apparent in FIGS. 4, 5 and 8.

The elastic memory of the cartridge elements (the simple beam B and the guard bar 21) is such that upon reduction or release of the aggressive shaving force F the cartridge returns to its normal blade geometry automatically.

The method of the present invention involves the provision of a blade, spacer, cap and guard bar assembly of standard length (of the order of 1.5 inches) exhibiting normal blade geometry at shaving forces ranging from 50 grams to 800 grams. That is, the blade, spacer and cap assembly supported as a simple beam is so selected that the bending moment resulting from usual and customary shaving forces does not alter blade geometry from normal geometry. A guard bar is provided which although flexible is more resistant to bending than the beam so that when aggressive shaving forces develop the geometry is altered and the risk of nicks and cuts is reduced substantially.

It is anticipated that a wide variety of modifications and design changes may be devised in the apparatus and method disclosed and described without departing from the spirit and scope of the invention.

What is claimed is:

1. A razor comprising a flexible blade package having one or more blade edges supported at each end as a fixed beam, a cooperating relatively rigid guard bar, said blade package and guard bar being positioned relative to one another to provide a given blade edge exposure, said blade package being operable in response to shaving forces to deflect relative to the guard to alter blade edge exposure, said guard bar being formed with a rod element effective to increase its resistance to bending.

2. A razor comprising a flexible blade package having one or more blade edges supported at each end as a fixed beam, a cooperating relatively rigid guard bar, said blade package and guard bar being positioned relative to one another to provide a given blade edge exposure, said blade package being operable in response to shaving forces to deflect relative to the guard to alter blade edge exposure, said guard bar being formed with a longitudinal notch to provide a hinge effect.

3. The razor of claim 2 in which the guard bar is formed with an elongated rod element effective to increase its resistance to bending.

* * * * *